United States Patent [19]

Werner

[11] Patent Number: 4,776,864

[45] Date of Patent: Oct. 11, 1988

[54] ELECTROSTATIC PRECIPITATOR

[75] Inventor: Frank J. Werner, Bergisch-Gladbach, Fed. Rep. of Germany

[73] Assignee: Walther & CIE Aktiengesellschaft, Cologne, Fed. Rep. of Germany

[21] Appl. No.: 74,917

[22] Filed: Jul. 17, 1987

[30] Foreign Application Priority Data

Jul. 29, 1986 [DE] Fed. Rep. of Germany ..... 3625547

[51] Int. Cl.[4] ..... B03C 3/14

[52] U.S. Cl. ..... 55/124; 55/128; 55/393; 55/413; 55/426; 55/427

[58] Field of Search ..... 55/6, 124, 125, 128, 55/133, 101, 392, 393, 413, 318, 426, 427

[56] References Cited

U.S. PATENT DOCUMENTS

| | | | |
|---|---|---|---|
| 821,819 | 5/1906 | Neumann | 55/393 X |
| 2,708,486 | 5/1955 | Hedberg | 55/124 |
| 2,708,487 | 5/1955 | Hedberg et al. | 55/125 |
| 2,712,858 | 7/1955 | Wintermute | 55/125 |
| 2,785,769 | 3/1957 | Pollock | 55/6 |
| 3,358,426 | 12/1967 | Husbjerg | 55/133 X |
| 4,522,634 | 6/1985 | Frank . | |

FOREIGN PATENT DOCUMENTS

| | | | |
|---|---|---|---|
| 162826 | 11/1985 | European Pat. Off. . | |
| 1487268 | 6/1967 | France | 55/124 |
| 314171 | 9/1919 | Fed. Rep. of Germany | 55/128 |
| 1457095 | 10/1969 | Fed. Rep. of Germany . | |
| 2733422 | 2/1978 | Fed. Rep. of Germany | 55/101 |

OTHER PUBLICATIONS

"Belco Electric Precipitators", Bulletin 172-68, Belco Pollution Control Corp., Paterson, N.J.

*Primary Examiner*—Kathleen J. Prunner
*Attorney, Agent, or Firm*—Peter K. Kontler

[57] ABSTRACT

An electrostatic precipitator wherein a gaseous carrier medium is caused to pass through one or more electrostatic filters to be relieved of the major percentage of impurities. The thus purified carrier medium is caused to flow through a tapering funnel-shaped section of the outlet wherein the lower layer of the flow is caused to enter an elongated horizontal slit-shaped aperture leading to a chamber which narrows in the direction of flow of carrier medium therein and discharges into a first conduit for evacuation of the lower layer. The upper layer enters a polygonal or cylindrical second conduit at a level above an adjustable flat or otherwise configurated partition which extends into the funnel-shaped section at the intake end of the second conduit and whose inclination can be changed to vary the size of the aperture leading to the chamber.

14 Claims, 2 Drawing Sheets

ELECTROSTATIC PRECIPITATOR

BACKGROUND OF THE INVENTION

The invention relates to apparatus for segregating solid particles and other impurities from a gaseous carrier medium, and more particularly to improvements in so-called electrostatic precipitators.

An electrostatic precipitator comprises a housing wherein a stream of gaseous carrier medium which contains solid particles and/or other impurities is conveyed past one or more electrostatic filters each of which can comprise a thin wire-like corona discharge electrode surrounded by a tubular collecting electrode. Solid particles and other impurities deposit on the collecting electrode and are evacuated by way of one or more collecting vessels at the bottom of the housing. The housing has an inlet for admission of untreated carrier medium and an outlet for evacuation of treated carrier medium. In many instances, the outlet includes a funnel-shaped section which tapers in the direction of flow of treated gaseous carrier medium therein and discharges such medium into a conduit. The just described electrostatic precipitators are often used for removal of impurities from industrial gases (e.g., flue gases in steam plants), for removal of acid mists in chemical process plants, for cleaning of air in ventilation and air conditioning systems, and for many other purposes.

The once treated gaseous carrier medium normally still contains a certain percentage of solid particles and/or other impurities (hereinafter referred to as solid particles). The carrier medium normally includes an upper layer which is devoid of solid particles or contains only a very small percentage of solid particles, and a lower layer which contains a higher percentage of solids. Such stratification of treated gaseous carrier medium is attributable to the nature of flow and/or velocity of carrier medium in the electrostatic precipitator.

In accordance with a proposal which is disclosed in European Pat. No. 0162826 Al, the outlet of the electrostatic precipitator is provided with an opening which allows for evacuation of some of the treated carrier medium along a separate path. The thus withdrawn portion of the carrier medium is then treated in a separate precipitator prior to being admitted into the conduit for the remaining part of the treated carrier medium. Alternatively, the segregated portion of the treated carrier medium is subjected to a secondary purifying treatment and is then introduced into the inlet of the electrostatic precipitator for renewed (third) treatment. The segregated portion constitutes a very small percentage of the once treated carrier medium. It has been found that such mode of diverting some of the treated medium does not ensure reliable segregation of a large percentage of solid particles from the once-treated gaseous carrier medium.

German Pat. No. 314,171 proposes to provide the outlet of the precipitator with lateral channels which divert some of the treated gaseous carrier medium. Such proposal is unsatisfactory because the highest percentage of solid particles can be found in the lower layer of the once treated carrier medium.

German Offenlegungsschrift No. 1457095 proposes to divide the conduit for once treated carrier medium into several smaller conduits which receive carrier medium by way of a funnel-shaped duct tapering in a direction from the purifying station toward the intake ends of the smaller conduits. The bottom wall of the funnel-shaped section slopes upwardly toward the intake ends of the smaller conduits. Solid particles which travel along such upwardly sloping wall enter a turbulent zone of the carrier medium at the intake ends of the conduits so that the solid particles are mixed with the carrier medium and their distribution in the conduits is unpredictable. Consequently, the uppermost conduit or two or more upper conduits are just as likely to contain a relatively high percentage of solid particles as the lowermost or lower conduits so that the apparatus of this publication is incapable of ensuring predictable subdivision of the outflowing stream of treated carrier medium into several smaller streams containing different quantities of solid particles.

OBJECTS AND SUMMARY OF THE INVENTION

An object of the invention is to provide a novel and improved apparatus for separating solid particles from a gaseous carrier medium in such a way that the once treated carrier medium can be reliably divided into several layers or streams each of which invariably contains a different percentage of solid particles.

Another object of the invention is to provide an apparatus which is constructed and assembled in such a way that solid particles which remain in the once-treated gaseous carrier medium are not likely to be agitated and redistributed in the carrier medium.

A further object of the invention is to provide an apparatus whose operation can be regulated, either automatically or manually, so as to ensure an optimum subdivision of treated carrier medium into streams which contain different percentages of unsegregated solid particles.

An additional object of the invention is to provide an electrostatic precipitator with novel and improved outlet means for the gaseous carrier medium.

Still another object of the invention is to provide a novel and improved method of removing solid particles from a gaseous carrier medium which has undergone a purifying treatment, particularly in an electrostatic precipitator.

One feature of the present invention resides in the provision of an apparatus for separating solid particles from a gaseous carrier medium. The apparatus comprises a housing having spaced-apart inlet and outlet means for the solids-laden carrier medium, and at least one electrostatic filter provided in the housing between the inlet and outlet means and including electrode means for deposition of some (normally the majority) of solid particles so that the carrier medium which reaches the outlet means contains only the remaining solid particles and forms a preferably horizontal or substantially horizontal flow or stream having an upper layer or stratum with a relatively low and a lower layer or stratum with a relatively high percentage of solid particles. The outlet means includes a first portion which defines a first path for the upper layer and a second portion defining a second path for the lower layer of the stream so that the upper and lower layers are segregated from each other. The second portion of the outlet means has a chamber which forms a portion of the second path, and the second portion of the outlet means further includes a partition which is disposed between the chamber and the first layer of the stream.

The housing can include a substantially funnel-shaped section which includes the second portion of the outlet means and has lateral and bottom walls which define the chamber jointly with the partition of the second portion of the outlet means.

The first portion of the outlet means can include a conduit, and the second portion of the outlet means has an opening for evacuation of gaseous carrier medium from the chamber. The opening is preferably adjacent the conduit, and the chamber preferably narrows in a direction from the aperture toward the opening.

The partition is or can be movable with reference to the first portion of the outlet means between a plurality of positions to thereby vary the area or size of the aperture, and the apparatus can further comprise means for maintaining the partition in a selected position. Such apparatus can further comprise sealing means between the aforementioned wall means and the partition to ensure that gaseous carrier medium can enter the chamber only by way of the aperture and can leave the chamber only by way of the evacuating opening.

The partition can include a plurality of mutually inclined panels in order to enlarge the size of the aperture for admission of the lower layer of the stream of carrier medium. The aforementioned conduit of the first portion of the outlet means includes a bottom wall, and a partition is located upstream of and preferably merges into the bottom wall of the conduit to thus reduce the likelihood of turbulence in the carrier medium in the region where the partition peels the lower layer from the upper layer of the stream of carrier medium. Such conduit can have a polygonal (e.g., a square or rectangular) cross-sectional outline.

The second portion of the outlet means can include a hollow conical or pyramidal funnel, and the conduit of the first portion of the outlet means has an intake end which is in communication with the apex of the funnel. The intake end can have a circular or substantially circular outline and the partition can surround a portion (e.g., approximately one-half) of the intake end.

Another feature of the present invention resides in the provision of a method of segregating solid particles from a gaseous carrier medium. The method comprises the steps of conveying the gaseous carrier medium along a predetermined first path, subjecting the carrier medium to the action of at least one electrostatic filter in at least one first portion of the path to thus segregate some (preferably a very high percentage of) solid particles from the carrier medium whereby the carrier medium which flows beyond the first portion forms a flow or stream including an upper layer with a relatively low and a lower layer with a relatively high percentage of solid particles, and peeling the lower layer off the upper layer of the stream in a second portion of the path downstream of the first portion. The peeling step can include placing a flat plate-like or an otherwise configurated partition between the upper and lower layers of the stream in such orientation that segregation of the lower layer from the upper layer takes place without any, or without appreciable, turbulence in the carrier medium.

The method can further comprise the step of narrowing the second portion of the path so that the cross-sectional area of the stream or flow decreases in the course of the peeling step.

Still further, the method can comprise the step of establishing for the peeled-off second layer a second path which has an enlarged portion adjacent the second portion of the first path. The enlarged portion can constitute the aforediscussed chamber, and such chamber preferably narrows in the direction of flow of the lower layer along the second path.

The novel features which are considered as characteristic of the invention are set forth in particular in the appended claims. The improved apparatus itself, however, both as to its construction and its mode of operation, together with additional features and advantages thereof, will be best understood upon perusal of the following detailed description of certain specific embodiments with reference to the accompanying drawing.

DESCRIPTION OF THE PREFERRED EMBODIMENTS

Figure 1:
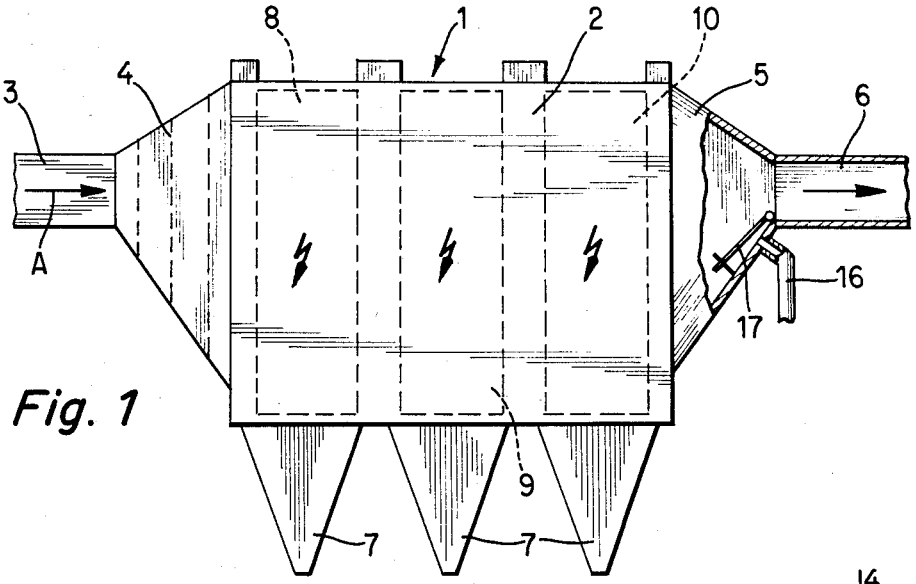
FIG. 1 is a schematic partly elevational and partly sectional view of an apparatus which embodies one form of the invention and comprises three electrostatic filters.
Figure 2:
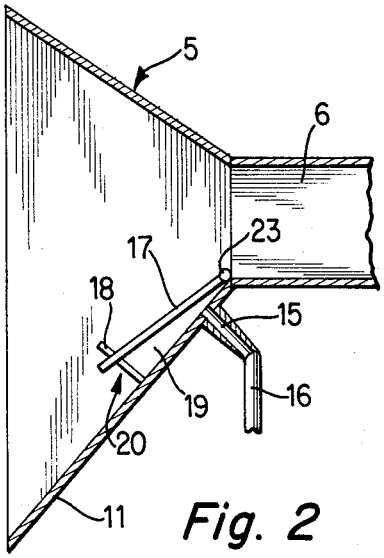
FIG. 2 is an enlarged view of the outlet of the apparatus which is shown in FIG. 1.
Figure 3:
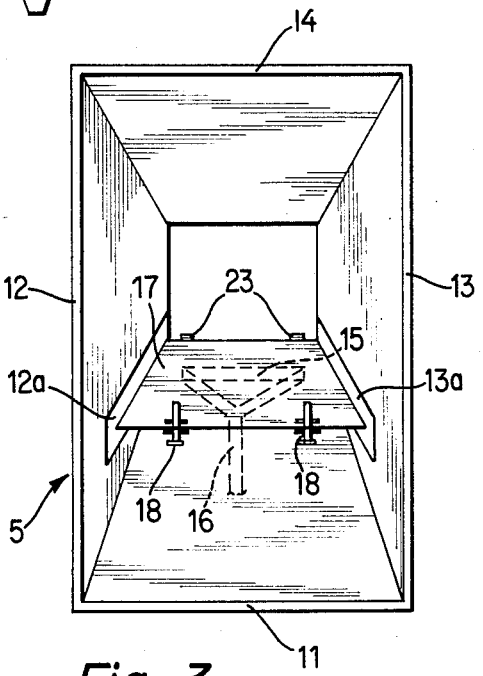
FIG. 3 is a view as seen from the left-hand side of FIG. 2.
Figure 4:
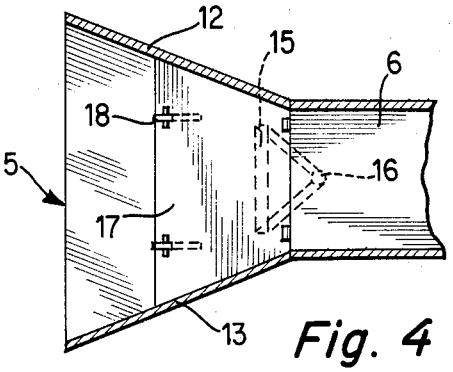
FIG. 4 is a horizontal sectional views of the outlet of FIG. 2.

Referring first to FIGS. 1 to 4, there is shown an apparatus which constitutes an electrostatic precipitator and includes a housing 1 defining an elongated horizontal or nearly horizontal path for the flow of a gaseous carrier medium for solid particles. The inlet of the housing 1 includes a conduit 3 which conveys a stream or flow of carrier medium (e.g., a crude gas which is contaminated by solid impurities) in the direction of arrow A, and the inlet further includes a funnel shaped hollow pyramidal portion or section 4 which receives the carrier medium from the conduit 3 and conveys the carrier medium (with solid particles therein) into a central or median portion 2 of the housing which contains one or more (for example, three) electrostatic filters 8, 9, 10 each of which includes a pair of electrodes which can cooperate in a manner as disclosed in commonly owned U.S. Pat. No. 4,522,634 granted June 11, 1985 for "Method and apparatus for automatic regulation of the operation of an electrostatic filter". The disclosure of this patent is incorporated herein by reference.

Solid particles which are separated by the filters 8, 9 and 10 are caused or allowed to descend into discrete collecting vessels 7 in the lower part of the median portion 2 of the housing 1.

The housing 1 further comprises an outlet for the gaseous carrier medium and for that percentage of solid particles which are not segregated from the carrier medium during passage along a meandering or otherwise configurated path portion defined by the electrodes of the filters 8, 9 and 10. The outlet comprises a section 5 which is a hollow pyramidal funnel having an apex which is connected with the intake end of a conduit 6 constituting a first portion of the outlet and serving to evacuate the upper layer of the stream or flow of carrier medium which leaves the median portion 2 of the housing 1 and enters the outlet including the funnel-shaped section 5 and the conduit 6. The upper layer of the stream or flow which enters the outlet of the housing 1 contains a low percentage of solid particles or is completely devoid of solid particles. The lower layer of such stream or flow contains a higher percentage of solid particles, and this lower portion is caused to enter an aperture 20 leading into a chamber 19 which is defined by a second portion of the outlet including the funnel-shaped section 5 and a flat partition 17 which is pivotally connected to the bottom wall 6*a* of the conduit 6 by one or more hinges 23 and serves to peel the lower layer of the carrier medium off the upper layer without any or without appreciable turbulence in the carrier medium in the region of the hinges 23. An opening 15 in the section 5 communicates with the chamber 19 and serves for evacuation of the lower layer of the stream or flow which leaves the median portion 2 of the housing 1 into a conduit 16. The section 5 has a top wall 14, a bottom wall 11 and two lateral walls or sidewalls 12, 13. The walls 11 to 13 cooperate with the partition 17 to define the chamber 19 and its aperture 20. In order to prevent uncontrolled escape of carrier medium and of solid particles therein from the chamber 19, while such carrier medium flows toward and into the opening 15, the apparatus preferably further comprises suitable elastic strips 12*a*, 13*a* or other suitable sealing elements which are interposed between the marginal portions of the partition 17 and the sidewalls 12, 13.

The means for maintaining the partition 17 in any one of a number of different positions (the size or area of the aperture 20 is varied in response to pivoting of the partition about the axis which is defined by the hinges 23) comprises two slotted rails 18 which extend upwardly from the bottom wall 11 of the funnel-shaped section 5 and guide suitable followers which are provided on the partition 17. The followers can include bolts and nuts which are tightened when the partition 17 reaches a selected position. The inclination of the partition 17 can be altered manually or automatically, e.g., in response to monitoring of the percentage of solid particles in the lower layer which enters the chamber 19 via aperture 20 and leaves the chamber 19 via opening 15 to be conveyed along the path which is defined by the conduit 16. The latter can discharge the carrier medium into the atmosphere or, if the carrier medium still contains a relatively high percentage of solid particles, back into the inlet 3, 4 of the housing 1.

The chamber 19 narrows in a direction from the aperture 20 toward the evacuating opening 15, and the opening 15 is an elongated narrow horizontal slot in the bottom wall 11 of the section 5. The aperture 20 also constitutes a narrow elongated horizontal slot which is bounded by the partition 17 from above, by the bottom wall 11 from below, and by the sidewalls 12, 13 at its sides. As can be seen in FIGS. 1 to 4, the opening 15 is closely adjacent the topmost portion of the bottom wall 11, i.e., it is close to the hinges 23 and to the intake end of the conduit 6 for the upper layer of the stream of gaseous carrier medium entering the outlet including the funnel-shaped section 5 and the conduit 6.

Figure 5:
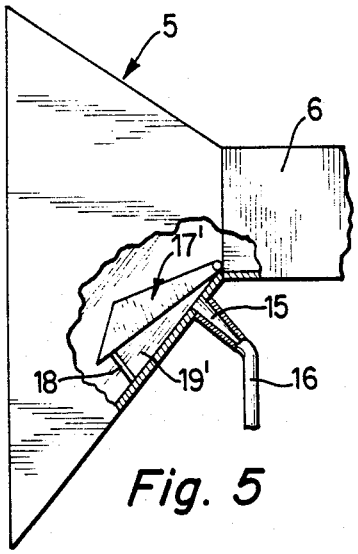
FIG. 5 is an elevational view of a modified outlet, with portions partly broken away.
Figure 6:
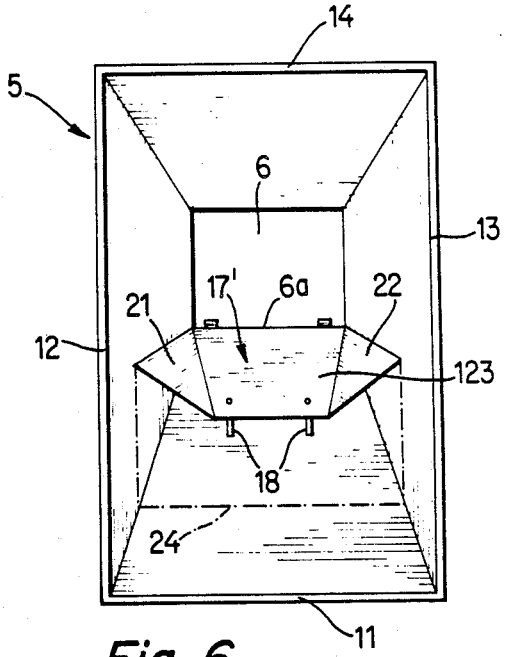
FIG. 6 is a view as seen from the left-hand side of FIG. 5.
Figure 7:
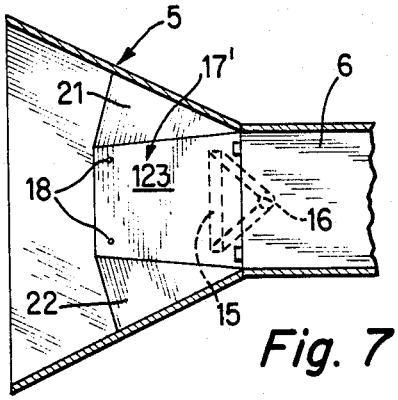
FIG. 7 is a horizontal sectional view of the outlet of FIG. 5.

FIGS. 5 to 7 show a portion of a modified outlet wherein the funnel-shaped section 5 forms part of or constitutes the second portion and contains a modified partition 17′ having three panels 21, 22, 123 which are mutually inclined in such a way that they cooperate with the walls 11, 12 and 13 to define a relatively large aperture 24 and a relatively large chamber 19′. In all other respects, the apparatus which embodies the outlet 5, 6 of FIGS. 5 to 7 can be identical with the apparatus of FIGS. 1 to 4.

Figure 8:
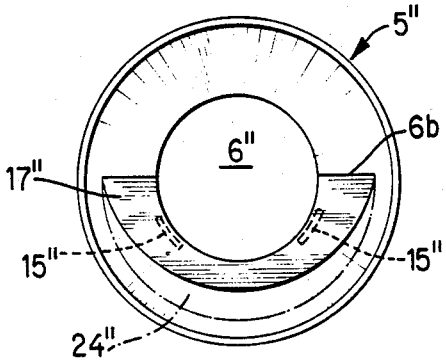
FIG. 8 is a view similar to that of FIG. 3 or 6 but showing a third outlet.

FIG. 8 shows an outlet with a hollow frustoconical funnel-shaped section 5″ and with a conduit 6″ having a circular cross-sectional outline. The partition 17″ is designed in such a way that it surrounds approximately one-half of the intake end of the conduit 6″. The two topmost portions of the partition 17″ extend to a level 6*b* which is the level of the axis of the conduit 6″. The aperture 24″ is relatively large and the chamber beneath the partition 17″ can discharge gaseous carrier medium into several slit-shaped evacuating openings 15″.

Figure 9:
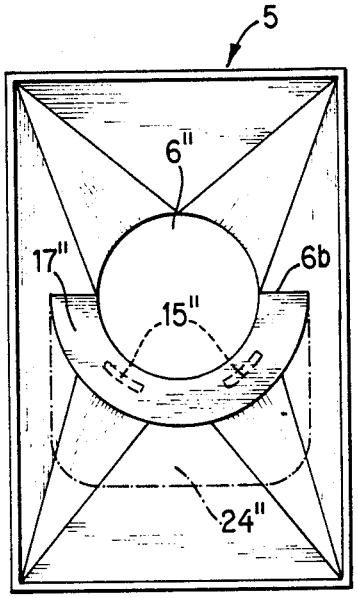
FIG. 9 is a view similar to that of FIG. 8 but showing a fourth outlet.

FIG. 9 shows a modified outlet which deviates from the outlet of FIG. 8 in that the circular intake end of the conduit 6″ communicates with the apex of a hollow frustopyramidal funnel-shaped section 5 similar to the section 5 of FIGS. 1 to 4. The partition 17″ again extends to the level 6*b*, i.e., to the level of the axis of the conduit 6″. The just described configuration of the partition 17″ in the outlets which are shown in FIGS. 8 and 9 is desirable and advantageous because such partition is less likely to create turbulence in the region where it is immediately adjacent the intake end of the conduit 6″. The partition 17″ is preferably adjustable to vary the area of the aperture 24″ substantially in the same way as described in connection with FIGS. 1 to 4. Thus, the inclination or orientation of the partition 17″ will be altered if a monitoring of the percentage of solid particles in the carrier medium leaving the chamber beneath the partition 17″ reveals that the percentage is very low (the area of the aperture 24″ can be reduced) or very high so that it is advisable to increase the area of the aperture 24″. Of course, a similar result can be obtained by monitoring the percentage of solid particles in the layer which is evacuated by way of the conduit 6″ and by adjusting the position of the partition 17″ accordingly.

An important advantage of the improved apparatus is its simplicity. Thus, the outlet of FIGS. 1–4, 5–7 or FIG. 8 or 9 can be installed in the housings of existing electrostatic precipitators to ensure a more satisfactory segregation of solid particles. Moreover, the segregating operation in the improved outlet can be regulated in dependency on the nature of the flow of carrier medium and in dependency on the percentage of solid particles in various layers or strata of the carrier medium which advances beyond the electrostatic filter or filters.

Another important advantage of the improved apparatus is that the rate of diversoon of a selected portion of the stream of flow entering the outlet of the apparatus can be varied in a very simple and efficient way and that the rate is changed in immediate response to a signal from a device whih monitors the percentage of solid particles in the upper and/or lower layer of the stream advancing beyond the electrostatic filter or filters. It has been found that the step of peeling off the lower layer of the stream from the upper layer is particularly effective if it takes place in close or immediate proximity of the intake end of the conduit 6 or 6″ for the upper layer.

A further important advantage of the improved apparatus is that the partition 17, 17′ or 17″ creates little or no turbulence in the stream of treated carrier medium.

Thus, solid particles which advance beyond the filter 10 and are adjacent the bottom wall 11 of the funnel-shaped hollow pyramidal section 5 or the corresponding portion of the hollow conical section 5'' of FIG. 8 can enter the chamber of the second portion of the outlet without any turbulence at all. The carrier medium which flows above the partition contains a relatively small percentage of solid particles or no solid particles so that eventual turbulence in this upper portion of the stream is or would be of no consequence. The feature that the partition merges into the bottom wall of a polygonal conduit 6 or surrounds the intake end of a cylindrical pipe-like conduit 6'' greatly reduces the likelihood of turbulence in any part of the stream which advances beyond the last electrostatic filter. The lower layer which enters the conduit 16 can be subjected to one or more additional cleaning treatments or is simply returned into the inlet of the housing if it contains a relatively high percentage of solid particles such as will warrant a second treatment in the median portion 2 of the housing.

It is normally desired to design the second portion of the outlet in such a way that it segregates a relatively small (lower) portion of the stream or flow of carrier medium which leaves the median portion 2 of the housing 1. The speed of the carrier medium which enters the aperture 20 or 24 need not be very high; it can be less than the average speed of carrier medium in the region of the partition 17, 17' or 17''. This ensures that inertia of solid particles in the lower portion of the stream contributes to reliable segregation of such particles from the carrier medium which enters the conduit 6 or 6''.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the appended claims.

I claim:

1. Apparatus for separating solid particles from a gaseous carrier medium, comprising a housing having spaced-apart inlet and outlet means for the carrier medium; and at least one electrostatic filter provided in said housing between said inlet and said outlet means and including electrode means for deposition of some solid particles thereat whereby the carrier medium which reaches said outlet means contains the remaining solid particles and forms a flow having an upper layer with a relatively low and a lower layer with a relatively high percentage of solid particles therein, said outlet means including a substantially funnel-shaped hollow section tapering in the direction of propagation of the flow therein, a first portion defining a first path and having a first aperture for admission of the upper layer of the flow in said section, and a second portion defining a second path and having a second aperture for admission of the lower layer of the flow in said section so that said layers are segregated from each other in said section, said second portion further having a chamber forming a portion of said second path and communicating with the interior of said section by way of said second aperture to receive the lower layer from said section, said second portion including a partition disposed in said section between said chamber and the first layer.

2. The apparatus of claim 1, wherein said funnel-shaped section has lateral and bottom walls defining said chamber jointly with said partition.

3. The apparatus of claim 1, wherein the first portion of said outlet means includes a conduit and the second portion of said outlet means has an opening for evacuation of gaseous carrier medium from said chamber, said opening being adjacent said conduit.

4. The apparatus of claim 3, wherein said chamber narrows in a direction from said second aperture toward said opening.

5. The apparatus of claim 1, wherein said partition is movable with reference to the first portion of said outlet means between a plurality of positions to thereby vary the area of said second aperture, and further comprising means for maintaining said partition in a selected position.

6. The apparatus of claim 5, wherein the second portion of said outlet means further comprises walls adjacent said partition and surrounding a portion of said chamber, and sealing means interposed between said partition and at least one of said walls.

7. The apparatus of claim 1, wherein the first portion of said outlet means includes a conduit having a bottom wall and said partition is located upstream of and merges into said bottom wall.

8. The apparatus of claim 7, wherein said conduit has a polygonal cross-sectional outline.

9. The apparatus of claim 8, wherein said conduit has a square or rectangular cross-sectional outline.

10. Apparatus for separating solid particles from a gaseous carrier medium, comprising a housing having spaced-apart inlet and outlet means for the carrier medium, and at least one electrostatic filter provided in said housing between said inlet and said outlet means and including electrode means for deposition of some solid particles thereat whereby the carrier medium which reaches said outlet means contains the remaining solid particles and forms a flow having an upper layer with a relatively low and a lower layer with a relatively high percentage of solid particles therein, said outlet means including a first portion defining a first path for the upper layer and a second portion defining a second path for the lower layer of said flow so that said layers are segregated from each other, said second portion having a chamber forming a portion of said second path and having an aperture for admission of the lower layer, said second portion including a partition between said chamber and the first layer and said chamber having an opening for evacuation of gaseous carrier medium, said partition including a plurality of mutually inclined panels and the second portion of said outlet means further including wall means bounding said aperture jointly with said panels, said chamber narrowing from said aperture toward said opening.

11. Apparatus for separating solid particles from a gaseous carrier medium, comprising a housing having spaced-apart inlet and outlet means for the carrier medium; and at least one electrostatic filter provided in said housing between said inlet and said outlet means including electrode means for deposition of some solid particles thereat whereby the carrier medium which reaches said outlet means contains the remaining solid particles and forms a flow having an upper layer with a relatively low and lower layer with a relatively high percentage of solid particles therein, said outlet means including a first portion defining a first path for the upper layer and a second portion defining a second path for the lower layrer of said flow so that said layers are segregated from each other, said second portion having a chamber forming a portion of said second path and having an aperture for admission of the lower layer, said second portion including a partition between said chamber and the first layer and the second portion of said outlet means including a hollow conical funnel having an apex, the first portion of said outlet means including a conduit having an intake end connected to said apex and said partition being disposed in said funnel and surrounding a portion of said intake end.

12. The apparatus of claim 11, wherein said conduit has a substantially circular cross-sectional outline and said partition surrounds approximately one-half of said intake end.

13. Apparatus for separating solid particles from a gaseous carrier medium, comprising a housing having spaced-apart inlet and outlet means for the carrier medium; and at least one electrostatic filter provided in said housing between said inlet and said outlet means and including electrode means for deposition of some solid particles thereat whereby the carrier medium which reaches said outlet means contains the remaining solid particles and forms a flow having an upper layer with a relatively low and a lower layer with a relatively high percentage of solid particles therein, said outlet means including a first portion defining a first path for the upper layer and a second portion defining a second path for the lower layer of said flow so that said layers are segregated from each other, said second portion having a chamer forming a portion of said second path and having an aperture for admission of the lower layer, said second portion including a partition between said chamber and the first layer and the second portion of said outlet mean including a hollow pyramidal funnel having an apex, the first portion of said outlet means including a conduit having an intake end connected to said apex and said partition being disposed in said funnel and surrounding a portion of said intake end.

14. The apparatus of claim 13, wherein said conduit has a substantially circular cross-sectional outline and said partition surrounds approximately one-half of said intake end.

* * * * *

UNITED STATES PATENT AND TRADEMARK OFFICE

CERTIFICATE OF CORRECTION

PATENT NO. : 4,776,864

DATED : October 11, 1988

INVENTOR(S) : Werner J. FRANK

It is certified that error appears in the above-identified patent and that said Letters Patent is hereby corrected as shown below:

Foremost Page [75] - "Frank J. WERNER" should read --Werner J. FRANK--.
Col. 4, line 24 - "views" should read --view--.
Col. 6, line 55 - "diversoon" should read --diversion--.
Col. 6, line 59 - "whih" should read --which--.
Col. 9, line 3 - "layrer" should read --layer--.

Signed and Sealed this

Twenty-ninth Day of August, 1989

*Attest:*

*Attesting Officer*

DONALD J. QUIGG

*Commissioner of Patents and Trademarks*